US009976573B2

(12) United States Patent
Martin et al.

(10) Patent No.: US 9,976,573 B2
(45) Date of Patent: May 22, 2018

(54) SYSTEM AND METHOD FOR IMPROVED DUCT PRESSURE TRANSFER IN PRESSURE EXCHANGE SYSTEM

(71) Applicant: ENERGY RECOVERY, INC., San Leandro, CA (US)

(72) Inventors: Jeremy Grant Martin, Oakland, CA (US); James Lee Arluck, Hayward, CA (US)

(73) Assignee: ENERGY RECOVERY, INC., San Leandro, CA (US)

( * ) Notice: Subject to any disclaimer, the term of this patent is extended or adjusted under 35 U.S.C. 154(b) by 310 days.

(21) Appl. No.: 14/819,008

(22) Filed: Aug. 5, 2015

(65) Prior Publication Data

US 2016/0040510 A1 Feb. 11, 2016

Related U.S. Application Data

(60) Provisional application No. 62/034,008, filed on Aug. 6, 2014.

(51) Int. Cl.

| | |
|---|---|
| ***F04F 99/00*** | (2009.01) |
| ***F04F 13/00*** | (2009.01) |
| ***E21B 43/26*** | (2006.01) |

(52) U.S. Cl.

CPC ..... *F04F 13/00* (2013.01); *E21B 43/26* (2013.01)

(58) Field of Classification Search

CPC ..... E21B 43/26; F04F 13/00; F04D 23/001; F04D 29/40; F04D 29/26

USPC ..... 417/64

See application file for complete search history.

(56) References Cited

U.S. PATENT DOCUMENTS

| | | | | |
|---|---|---|---|---|
| 2,904,245 | A * | 9/1959 | Pearson | F04F 13/00 417/226 |
| 3,699,845 | A | 10/1972 | Ifield | |
| 4,002,414 | A * | 1/1977 | Coleman, Jr. | F02C 3/02 416/223 A |
| 4,232,999 | A * | 11/1980 | Croes | F02B 33/42 123/559.2 |

(Continued)

FOREIGN PATENT DOCUMENTS

| | | |
|---|---|---|
| GB | 967525 A | 8/1964 |
| RU | 2004856 C1 | 12/1993 |

OTHER PUBLICATIONS

PCT International Search Report and Written Opinion; Application No. PCT/US2015/044097; dated Nov. 25, 2015; 12 pages.

(Continued)

*Primary Examiner* — Charles Freay
(74) *Attorney, Agent, or Firm* — Fletcher Yoder, P.C.

(57) ABSTRACT

A rotary isobaric pressure exchanger (IPX) includes a first end cover having a first surface that interfaces with a first end face of a rotor, wherein the first end cover has at least one first fluid inlet and at least one first fluid outlet. The IPX includes a second end cover having a second surface that interfaces with a second end face of the rotor, wherein the second end cover has at least one second fluid inlet and at least one second fluid outlet. The IPX includes a port disposed through the first surface of the first end cover or through the second surface of the second end cover, wherein during rotation of the cylindrical rotor about the rotational axis the port is configured to fluidly communicate with at least one channel of the plurality of channels within the rotor.

20 Claims, 8 Drawing Sheets

(56) References Cited

U.S. PATENT DOCUMENTS

| | | | | | |
|---|---|---|---|---|---|
| 4,288,203 | A * | 9/1981 | Fried | F04F 13/00 | 417/64 |
| 4,352,638 | A * | 10/1982 | Vallance | F04F 13/00 | 416/DIG. 3 |
| 4,796,595 | A * | 1/1989 | El-Nashar | F02B 33/42 | 123/559.2 |
| 5,538,401 | A * | 7/1996 | Schaffner | F04B 1/2035 | 417/222.1 |
| 5,807,080 | A * | 9/1998 | Ochiai | F04B 1/2021 | 417/269 |
| 6,510,779 | B2 * | 1/2003 | Greene | F04B 1/2021 | 417/270 |
| 6,540,487 | B2 | 4/2003 | Polizos | | |
| 2009/0180903 | A1 | 7/2009 | Martin et al. | | |
| 2013/0280038 | A1 * | 10/2013 | Martin | F03B 13/00 | 415/110 |
| 2013/0294944 | A1 * | 11/2013 | Hirosawa | B01D 61/06 | 417/53 |

OTHER PUBLICATIONS

CA Office Action for CA Application No. 2,957,284 dated Jan. 2, 2018; 5 pgs.

Russian Office Action; Application No. RU 2017107229; dated Mar. 16, 2018; 14 pages.

* cited by examiner

SYSTEM AND METHOD FOR IMPROVED DUCT PRESSURE TRANSFER IN PRESSURE EXCHANGE SYSTEM

CROSS-REFERENCE TO RELATED APPLICATIONS

This application is a non-provisional of U.S. Provisional Patent Application No. 62/034,008, entitled "SYSTEM AND METHOD FOR IMPROVED DUCT PRESSURE TRANSFER IN PRESSURE EXCHANGE SYSTEM", filed Aug. 6, 2014, which is herein incorporated by reference in its entirety.

BACKGROUND

This section is intended to introduce the reader to various aspects of art that may be related to various aspects of the present subject matter, which are described and/or claimed below. This discussion is believed to be helpful in providing the reader with background information to facilitate a better understanding of the various aspects of the present subject matter. Accordingly, it should be understood that these statements are to be read in this light, and not as admissions of prior art.

The subject matter disclosed herein relates to rotating equipment, and, more particularly, to systems and methods for improving duct pressure transfer in a pressure exchange system.

Rotating equipment, such as rotating fluid handling equipment, may be used in a variety of applications. In certain applications, upstream and/or downstream equipment may rely on a substantially continuous and/or substantially uniform speed of operation of the rotating equipment. For example, the rotating fluid handling equipment (e.g., pump) may ensure a continuous supply of fluid from one location to another. Unfortunately, the rotating fluid handling equipment may be susceptible to stall conditions in certain applications. For example, the rotating fluid handling equipment may not be capable of reliably handling particle-laden fluid flows. The stall conditions may be more likely to occur with particle-laden fluid flows, because solid particulate may work its way into spaces between a rotor and a stator of the rotating fluid handling equipment. As a result, the rotating fluid handling equipment may be susceptible to undesirable fluctuations in speed, gradual reductions in speed, rapid and substantial reductions in speed, or a complete stall of the rotor. All of these conditions may result in downtime for inspection, servicing, and/or repair, or a complete replacement of the rotating fluid handling equipment. If the rotating fluid handling equipment is essential for operation of a larger system, then the downtime may result in downtime of the entire system, causing substantial losses in revenue among other things.

BRIEF DESCRIPTION OF THE DRAWINGS

Various features, aspects, and advantages of the present subject matter will become better understood when the following detailed description is read with reference to the accompanying figures in which like characters represent like parts throughout the figures, wherein.

DETAILED DESCRIPTION OF SPECIFIC EMBODIMENTS

Figure 1:
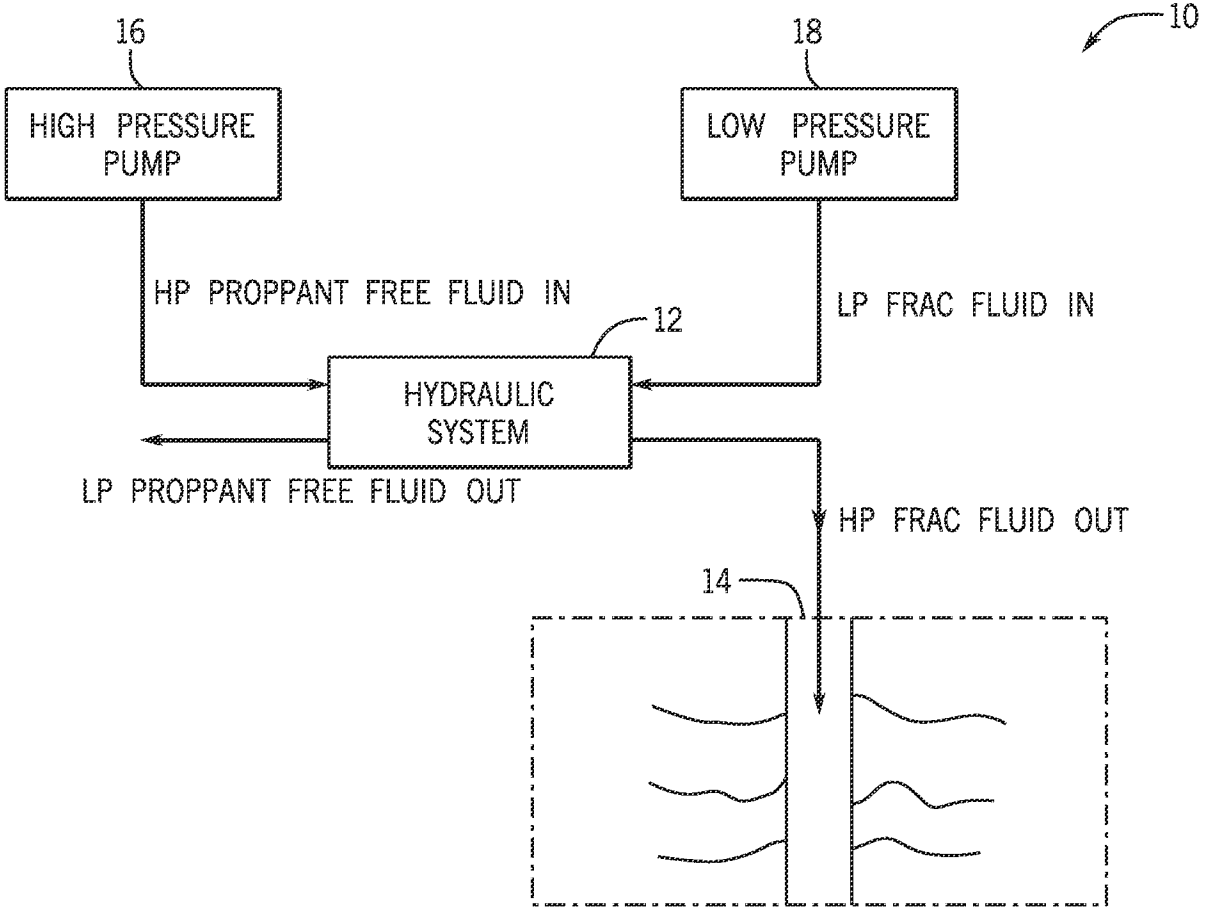
FIG. 1 is a schematic diagram of an embodiment of a frac system with a hydraulic energy transfer system.

One or more specific embodiments of the present subject matter will be described below. These described embodiments are only exemplary of the present subject matter. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present subject matter, the articles "a," "an," "the," and "said" are intended to mean that there are one or more of the elements. The terms "comprising," "including," and "having" are intended to be inclusive and mean that there may be additional elements other than the listed elements.

As discussed in detail below, a frac system (or hydraulic fracturing system) includes a hydraulic energy transfer system that transfers work and/or pressure between first and second fluids, such as a pressure exchange fluid (e.g., a substantially proppant free fluid, such as water) and a hydraulic fracturing fluid (e.g., a proppant-laden frac fluid). The hydraulic energy transfer system may also be described as a hydraulic protection system, hydraulic buffer system, or a hydraulic isolation system, because it may block or limit contact between a frac fluid and various hydraulic fracturing equipment (e.g., high-pressure pumps) while exchanging work and/or pressure with another fluid. The hydraulic energy transfer system may include a hydraulic pressure exchange system, such as a rotating isobaric pressure exchanger (IPX). The IPX may include one or more chambers (e.g., 1 to 100) to facilitate pressure transfer and equalization of pressures between volumes of first and second fluids (e.g., gas, liquid, or multi-phase fluid). For example, one of the fluids (e.g., the frac fluid) may be a multi-phase fluid, which may include gas/liquid flows, gas/solid particulate flows, liquid/solid particulate flows, gas/liquid/solid particulate flows, or any other multi-phase flow. In some embodiments, the pressures of the volumes of first and second fluids may not completely equalize. Thus, in certain embodiments, the IPX may operate isobarically, or the IPX may operate substantially isobarically (e.g., wherein the pressures equalize within approximately +/−1, 2, 3, 4, 5, 6, 7, 8, 9, or 10 percent of each other). In certain embodiments, a first pressure of a first fluid (e.g., pressure exchange fluid) may be greater than a second pressure of a second fluid (e.g., frac fluid). For example, the first pressure may be between approximately 5,000 kPa to 25,000 kPa, 20,000 kPa to 50,000 kPa, 40,000 kPa to 75,000 kPa, 75,000 kPa to 100,000 kPa or greater than the second pressure. Thus, the IPX may be used to transfer pressure from a first fluid (e.g., pressure exchange fluid) at a higher pressure to a second fluid (e.g., frac fluid) at a lower pressure. In some embodiments, the IPX may transfer pressure between a first fluid (e.g., pressure exchange fluid, such as a first proppant free or substantially proppant free fluid) and a second fluid that may be highly viscous and/or contain proppant (e.g., frac fluid containing sand, solid particles, powders, debris, ceramics). In operation, the hydraulic energy transfer system blocks or limits contact between the second proppant containing fluid and various fracturing equipment (e.g., high-pressure pumps) during fracturing operations. By blocking or limiting contact between various fracturing equipment and the second proppant containing fluid, the hydraulic energy transfer system increases the life/performance while reducing abrasion/wear of various fracturing equipment (e.g., high-pressure pumps). Moreover, it may enable the use of cheaper equipment in the fracturing system by using equipment (e.g., high-pressure pumps) not designed for abrasive fluids (e.g., frac fluids and/or corrosive fluids).

FIG. 1 is a schematic diagram of an embodiment of the frac system 10 with a hydraulic energy transfer system 12. In operation, the frac system 10 enables well completion operations to increase the release of oil and gas in rock formations. Specifically, the frac system 10 pumps a frac fluid containing a combination of water, chemicals, and proppant (e.g., sand, ceramics, etc.) into a well 14 at high-pressures. The high-pressures of the frac fluid increases crack size and propagation through the rock formation, which releases more oil and gas, while the proppant prevents the cracks from closing once the frac fluid is depressurized. As illustrated, the frac system 10 includes a high-pressure pump 16 and a low-pressure pump 18 coupled to a hydraulic energy transfer system 12 (e.g., IPX). In operation, the hydraulic energy transfer system 12 transfers pressures between a first fluid (e.g., proppant free fluid) pumped by the high-pressure pump 16 and a second fluid (e.g., proppant containing fluid or frac fluid) pumped by the low-pressure pump 18. In this manner, the hydraulic energy transfer system 12 blocks or limits wear on the high-pressure pump 16, while enabling the frac system 10 to pump a high-pressure frac fluid into a well 14 to release oil and gas.

In an embodiment using an isobaric pressure exchanger (IPX), the first fluid (e.g., high-pressure proppant free fluid) enters a first side of the hydraulic energy transfer system 12 where the first fluid contacts the second fluid (e.g., low-pressure frac fluid) entering the IPX on a second side. The contact between the fluids enables the first fluid to increase the pressure of the second fluid, which drives the second fluid out of the IPX and down a well 14 for fracturing operations. The first fluid similarly exits the IPX, but at a low-pressure after exchanging pressure with the second fluid.

As used herein, the isobaric pressure exchanger (IPX) may be generally defined as a device that transfers fluid pressure between a high-pressure inlet stream and a low-pressure inlet stream at efficiencies in excess of approximately 50%, 60%, 70%, or 80% without utilizing centrifugal technology. In this context, high pressure refers to pressures greater than the low pressure. The low-pressure inlet stream of the IPX may be pressurized and exit the IPX at high pressure (e.g., at a pressure greater than that of the low-pressure inlet stream), and the high-pressure inlet stream may be depressurized and exit the IPX at low pressure (e.g., at a pressure less than that of the high-pressure inlet stream). Additionally, the IPX may operate with the high-pressure fluid directly applying a force to pressurize the low-pressure fluid, with or without a fluid separator between the fluids. Examples of fluid separators that may be used with the IPX include, but are not limited to, pistons, bladders, diaphragms and the like. In certain embodiments, isobaric pressure exchangers may be rotary devices. Rotary isobaric pressure exchangers (IPXs) 20, such as those manufactured by Energy Recovery, Inc. of San Leandro, Calif., may not have any separate valves, since the effective valving action is accomplished internal to the device via the relative motion of a rotor with respect to end covers, as described in detail below with respect to FIGS. 3-7. Rotary IPXs may be designed to operate with internal pistons to isolate fluids and transfer pressure with relatively little mixing of the inlet fluid streams. Reciprocating IPXs may include a piston moving back and forth in a cylinder for transferring pressure between the fluid streams. Any IPX or plurality of IPXs may be used in the disclosed embodiments, such as, but not limited to, rotary IPXs, reciprocating IPXs, or any combination thereof. In addition, the IPX may be disposed on a skid separate from the other components of a fluid handling system, which may be desirable in situations in which the IPX is added to an existing fluid handling system.

The inherent compressibility of fluids may cause high velocity jets of fluid into and out of rotor ducts during pressure transitions within the IPX. In certain situations, these jets may act to apply forces counter to the direction of rotation of a rotor. The force of the jets may increase with increasing pressure (e.g., at higher pressures utilized during fracing operations) and may cause the rotor to slow down with increasing pressure. In certain situations, it may be desirable to improve duct (e.g., rotor duct) pressure transfer to counteract the forces that may hinder rotation of the rotor and to generate forces to promote rotation of the rotor. Thus, in certain embodiments, end covers adjacent the rotor in the IPX may each include one or more holes or ports in the end cover face (e.g., adjacent particular end cover ducts) to enable pressurization of fluid within the rotor duct (e.g., rotor channel) before the rotor duct is exposed to the bulk flow within the end cover and/or to enable depressurization of fluid within the rotor duct before the bulk flow exits via the end cover. For example, a high pressure seal area (or transition area) of the end cover prior to the low pressure end cover opening (e.g., low pressure duct) may include one or more holes and/or the low pressure seal area (or transition area) prior to the high pressure end cover opening (e.g., high pressure duct) may include one or more holes to improve duct pressure transfer. In certain embodiments, each transition area of an end cover may include one or more openings or ports. In certain embodiments, the holes or ports may be angled to utilize the energy transfer in aiding rotor rotation rather than oppose rotor rotation. Although the features to improve duct pressure transfer are discussed in relation to the IPX, these features may be utilized with any rotary machine, reciprocating machine (e.g., pumps), and so forth.

Figure 2:
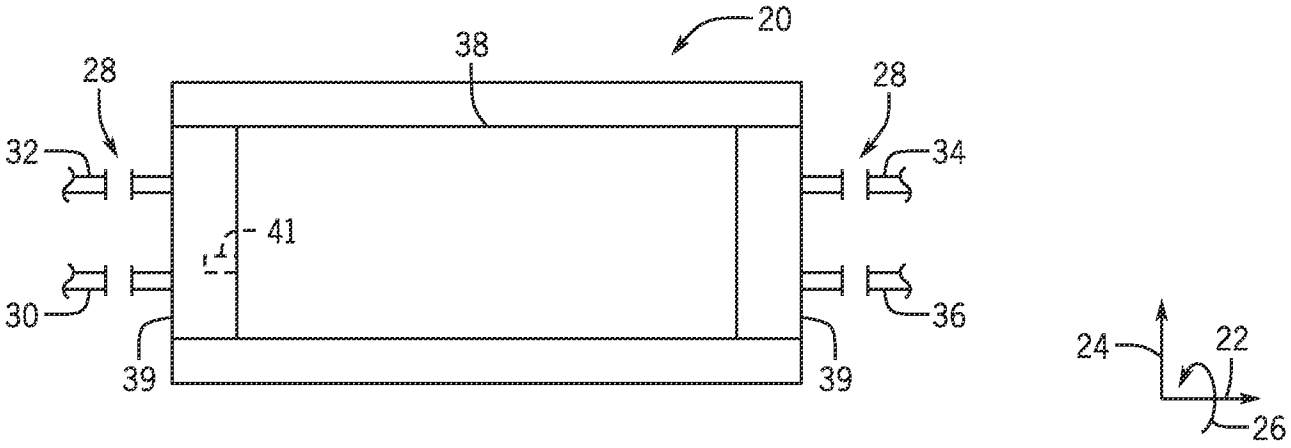
FIG. 2 is a schematic diagram of an embodiment of an isobaric pressure exchanger (IPX) having improved duct pressure transfer.

FIG. 2 is a schematic diagram of an embodiment of the IPX 20 that may be used with the features to improve duct pressure transfer. In the following discussion, reference may be made to an axial direction 22, a radial direction 24, and/or a circumferential direction 26 relative to a rotational axis of the IPX 20. As shown in FIG. 2, the IPX 20 may have a variety of fluid connections 28, such as a first fluid inlet 30, a first fluid outlet 32, a second fluid inlet 34, and/or a second fluid outlet 36. In certain embodiments, the first and/or second fluids may include solids, such as particles, powders, debris, and so forth. Each of the fluid connections 28 to the IPX 20 may be made using flanged, screwed, or other types of fittings. The IPX 20 may include a rotating component, such as a rotor 38, which may rotate in the circumferential direction 26. In addition, end covers 39 (which slidingly and sealingly engage respective end faces of the rotor 38) of the IPX 20 may each include one or more ports 41 or openings (e.g., a portion of a port 41 or opening is depicted in FIG. 2) to facilitate depressurization of a fluid exiting a rotor duct or pressurization of a fluid entering the rotor duct, thereby improving rotor duct pressure transfer.

Figure 3:
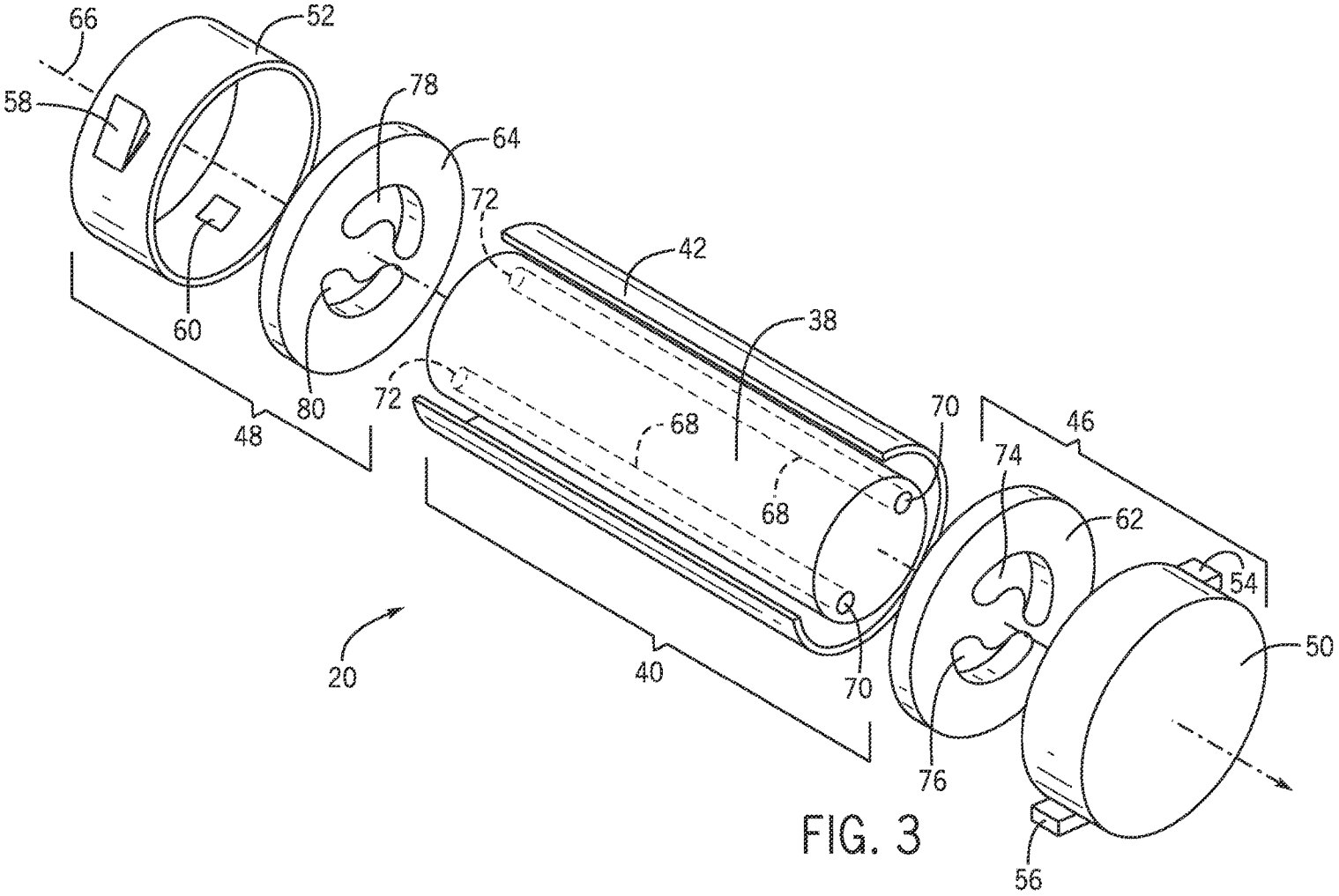
FIG. 3 is an exploded perspective view of an embodiment of a rotary IPX.

FIG. 3 is an exploded view of an embodiment of a rotary IPX 20. In the illustrated embodiment, the rotary IPX 20 may include a generally cylindrical body portion 40 that includes a sleeve 42 and a rotor 38. The rotary IPX 20 may also include two end structures 46 and 48 that include manifolds 50 and 52, respectively. Manifold 50 includes inlet and outlet ports 54 and 56 and manifold 52 includes inlet and outlet ports 60 and 58. For example, inlet port 54 may receive a high-pressure first fluid and the outlet port 56 may be used to route a low-pressure first fluid away from the IPX 20. Similarly, inlet port 60 may receive a low-pressure second fluid and the outlet port 58 may be used to route a high-pressure second fluid away from the IPX 20. The end structures 46 and 48 include generally flat end plates or end covers 62 and 64, respectively, disposed within the manifolds 50 and 52, respectively, and adapted for liquid sealing contact with the rotor 38. The rotor 38 may be cylindrical and disposed in the sleeve 42, and is arranged for rotation about a longitudinal axis 66 (e.g., rotational axis) of the rotor 38. The rotor 38 may have a plurality of channels 68 (e.g., rotor ducts) extending substantially longitudinally through the rotor 38 with openings 70 and 72 at each end arranged about the longitudinal axis 66. The openings 70 and 72 of the rotor 38 are arranged for hydraulic communication with the end plates 62 and 64, and inlet and outlet apertures 74 and 76, and 78 and 80, in such a manner that during rotation they alternately hydraulically expose liquid at high pressure and liquid at low pressure to the respective manifolds 50 and 52. The inlet and outlet ports 54, 56, 58, and 60, of the manifolds 50 and 52 form at least one pair of ports for high-pressure liquid in one end element 46 or 48, and at least one pair of ports for low-pressure liquid in the opposite end element, 48 or 46. The end plates 62 and 64, and inlet and outlet apertures 74 and 76, and 78 and 80 may be designed with perpendicular flow cross sections in the form of arcs or segments of a circle.

In addition, because the IPX 20 is configured to be exposed to the first and second fluids, certain components of the IPX 20 may be made from materials compatible with the components of the first and second fluids. In addition, certain components of the IPX 20 may be configured to be physically compatible with other components of the fluid handling system. For example, the ports 54, 56, 58, and 60 may comprise flanged connectors to be compatible with other flanged connectors present in the piping of the fluid handling system. In other embodiments, the ports 54, 56, 58, and 60 may comprise threaded or other types of connectors.

FIGS. 4-7 are exploded views of an embodiment of the rotary IPX 20 illustrating the sequence of positions of a single channel 68 in the rotor 38 as the channel 68 rotates through a complete cycle, and are useful to an understanding of the rotary IPX 20. It is noted that FIGS. 4-7 are simplifications of the rotary IPX 20 showing one channel 68 and the channel 68 is shown as having a circular cross-sectional shape. In other embodiments, the rotary IPX 20 may include a plurality of channels 68 with different cross-sectional shapes. Thus, FIGS. 4-7 are simplifications for purposes of illustration, and other embodiments of the rotary IPX 20 may have configurations different from that shown in FIGS. 4-7. As described in detail below, the rotary IPX 20 facilitates a hydraulic exchange of pressure between two liquids by putting them in momentary contact within a rotating chamber. In certain embodiments, this exchange happens at a high speed that results in very high efficiency with very little mixing of the liquids.

Figure 4:
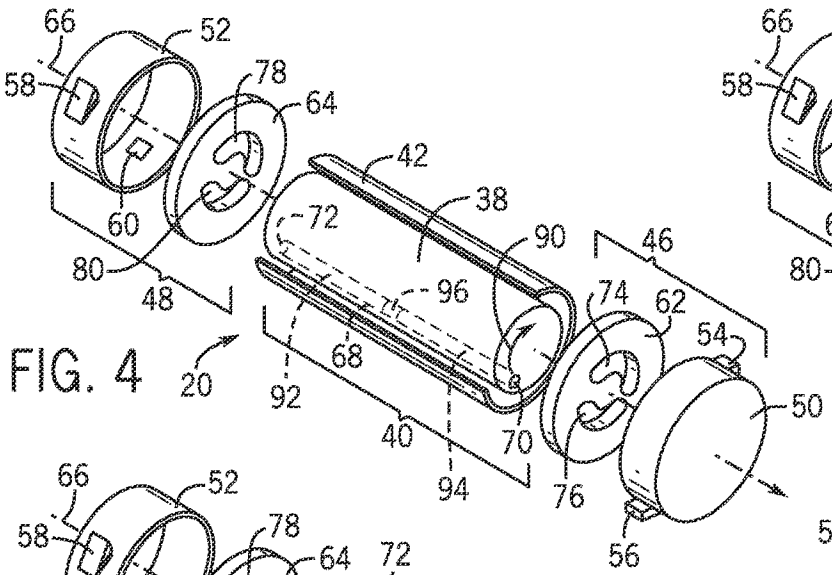
FIG. 4 is an exploded perspective view of an embodiment of a rotary IPX in a first operating position.

In FIG. 4, the channel opening 70 is in hydraulic communication with aperture 76 in endplate 62 and therefore with the manifold 50 at a first rotational position of the rotor 38 and opposite channel opening 72 is in hydraulic communication with the aperture 80 in endplate 64, and thus, in hydraulic communication with manifold 52. As discussed below, the rotor 38 rotates in the clockwise direction indicated by arrow 90. As shown in FIG. 4, low-pressure second fluid 92 passes through end plate 64 and enters the channel 68, where it pushes first fluid 94 out of the channel 68 and through end plate 62, thus exiting the rotary IPX 20. The first and second fluids 92 and 94 contact one another at an interface 96 where minimal mixing of the liquids occurs because of the short duration of contact. The interface 96 is a direct contact interface because the second fluid 92 directly contacts the first fluid 94.

Figure 5:
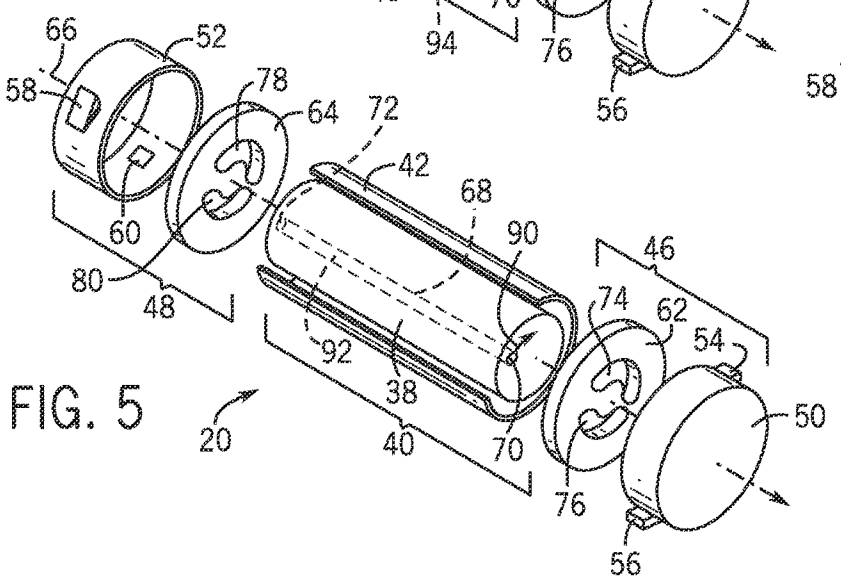
FIG. 5 is an exploded perspective view of an embodiment of a rotary IPX in a second operating position.

In FIG. 5, the channel 68 has rotated clockwise through an arc of approximately 90 degrees, and outlet 72 is now blocked off between apertures 78 and 80 of end plate 64, and outlet 70 of the channel 68 is located between the apertures 74 and 76 of end plate 62 and, thus, blocked off from hydraulic communication with the manifold 50 of end structure 46. Thus, the low-pressure second fluid 92 is contained within the channel 68.

Figure 6:
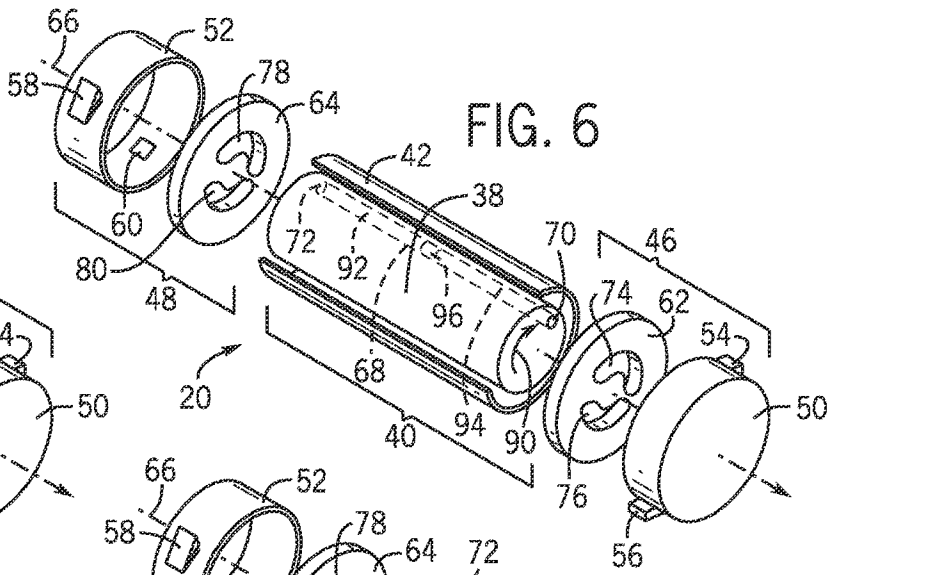
FIG. 6 is an exploded perspective view of an embodiment of a rotary IPX in a third operating position.

In FIG. 6, the channel 68 has rotated through approximately 180 degrees of arc from the position shown in FIG. 4. Opening 72 is in hydraulic communication with aperture 78 in end plate 64 and in hydraulic communication with manifold 52, and the opening 70 of the channel 68 is in hydraulic communication with aperture 74 of end plate 62 and with manifold 50 of end structure 46. The liquid in channel 68, which was at the pressure of manifold 52 of end structure 48, transfers this pressure to end structure 46 through outlet 70 and aperture 74, and comes to the pressure of manifold 50 of end structure 46. Thus, high-pressure first fluid 94 pressurizes and displaces the second fluid 92.

Figure 7:
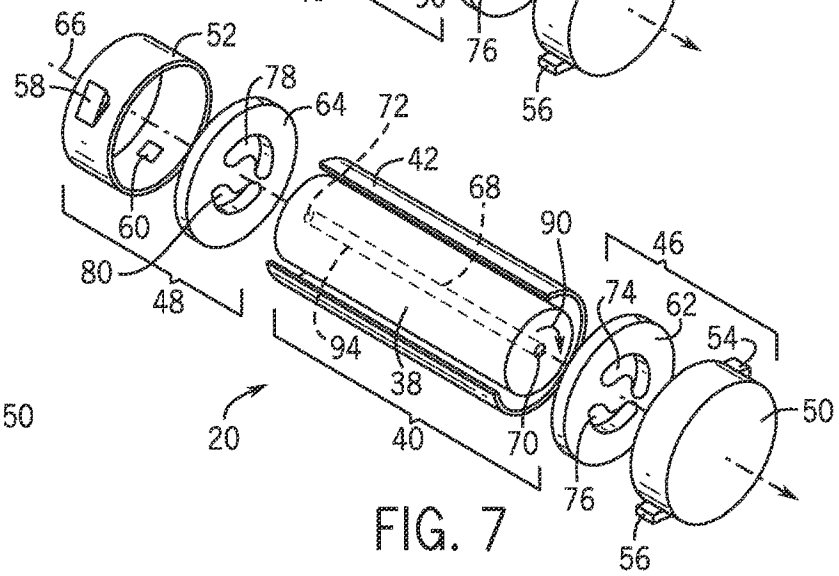
FIG. 7 is an exploded perspective view of an embodiment of a rotary IPX in a fourth operating position.

In FIG. 7, the channel 68 has rotated through approximately 270 degrees of arc from the position shown in FIG. 4, and the openings 70 and 72 of channel 68 are between apertures 74 and 76 of end plate 62, and between apertures 78 and 80 of end plate 64. Thus, the high-pressure first fluid 94 is contained within the channel 68. When the channel 68 rotates through approximately 360 degrees of arc from the position shown in FIG. 4, the second fluid 92 displaces the first fluid 94, restarting the cycle.

Figure 8:
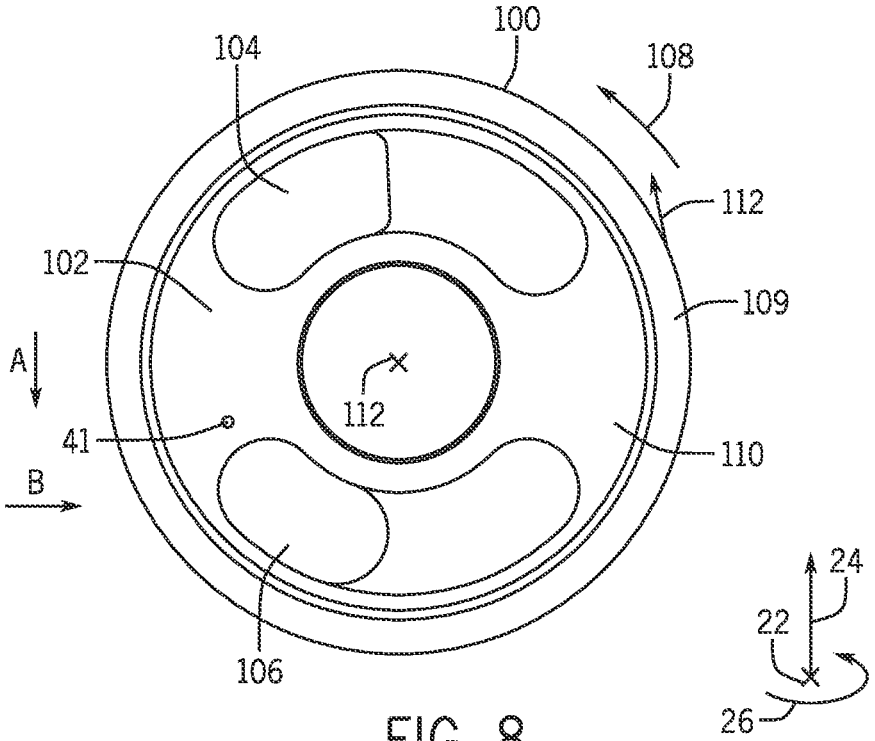
FIG. 8 is a radial view of an embodiment of an end cover of a rotary IPX (e.g., having a port or opening for improved duct pressure transfer during depressurization of a rotor duct volume)

FIG. 8 is a radial view of an embodiment of an end cover 100 of a rotary IPX 20 (e.g., having a port or opening 41 for improved duct pressure transfer during depressurization of a duct volume). Specifically, as depicted in FIG. 8, the end cover 100 (e.g., low pressure inlet end cover) may include a port or opening 41 through a seal area 102 (e.g., high pressure seal area), surface, or transition area (e.g., from high pressure outlet 104 to low pressure inlet 106 in a direction of rotation 108) of a surface 109 of the end cover 100 that interfaces with an end face of the rotor 38 adjacent to or just prior to the low pressure inlet 106. The surface 109 of the end cover 100 includes a transition area 110 disposed opposite the seal area 102 (e.g., from low pressure inlet 106 to the high pressure outlet 104 in the direction 108). The port or opening 41 is offset from a center point 112 of the end cover 100 and is aligned with a circumferential path of one or more rotor ducts or passages 68. In embodiments, with more than one port or opening 41, each port or opening 41 may be aligned with a respective circumferential path of one or more respective rotor ducts or passages 68. A low pressure fluid may enter into end cover 100 (and subsequently into the rotor 38 or rotor duct 68) via the low pressure inlet 106. During the rotation of the rotor 38 or rotor duct 68 from the low pressure inlet 106 to the high pressure outlet 104, a pressure transition from low to high pressure may occur to the fluid within rotor duct 68. A portion of the fluid within the rotor duct 68 may exit via the high pressure outlet 104. As the rotor 38 or rotor duct 68 rotates in the circumferential direction 26 from the high pressure outlet 104 towards the low pressure inlet 106, the fluid interfaces with the seal area 102 (e.g., high pressure seal area) of the end cover 100 prior to reaching the low pressure inlet 106. A portion of fluid (high pressure fluid) may exit the rotor duct 68 into the end cover 100 via the port or opening 41 disposed adjacent to or just prior to the low pressure inlet 106 and the fluid subsequently exits the end cover 100. The exit of the portion of the high pressure fluid through the port or opening 41 may enable a depressurization of the duct volume prior to interfacing with the low pressure fluid entering the rotor duct 68 via the low pressure inlet 106. An axis of the opening or port 41 located adjacent to or just prior to the low pressure inlet 106 may be partially directed tangential to the rotor rotation 108 and in the opposite direction of rotation to generate a reaction force and momentum in the direction of rotor rotation as indicated by arrow 112. In certain embodiments, the port or opening 41 may be angled. In certain embodiments, the port or opening 41 may include a compound angle. For example, the port or opening 41 may be angled relative to an axis of rotation of the rotor 38. The angle of the port or opening 41 may range from approximately 0 to 90 degrees relative to the rotational axis of the rotor 38 in direction A from the high pressure outlet 104 towards the low pressure inlet 106. The angle in direction A may be between approximately 0 to 45 degrees, 45 to 90 degrees, 15 to 30 degrees, 60 to 75 degrees, and all subranges therein. For example, the angle in direction A may be approximately 0, 10, 20, 30, 40, 50, 60, 70, 80, or 90, or any other angle therebetween. Also, the port or opening 41 may be angled so that the port or opening 41 is tangential to the rotor duct 68. The angle of the port or opening 41 may range from approximately 0 to 90 degrees relative to the rotational axis of the rotor 38 in direction B (e.g., from the high pressure seal area towards the opposite seal area) towards the radial wall of the rotor 38 or rotor duct 68. The angle in direction B may be between approximately 0 to 45 degrees, 45 to 90 degrees, 15 to 30 degrees, 60 to 75 degrees, and all subranges therein. For example, the angle in direction B may be approximately 0, 10, 20, 30, 40, 50, 60, 70, 80, or 90, or any other angle therebetween. In certain embodiments, the seal area 102 (e.g., high pressure seal area) may include more than one hole 41 adjacent to or just prior to the low pressure inlet 106. In certain embodiments, a cross-sectional area of the port or opening 41 may include an elliptical shape (e.g., oval or circle). In other embodiments, the cross-sectional area of the port or opening 41 may be another shape (e.g., triangular, rectilinear, star-shaped, and so forth). Location of port 41, shape of port 41, angle of port 41, and/or number of ports 41 is based the pressure, duct geometry, compressibility of fluid being utilized, and/or rotary speed of the rotor 38.

Figure 9:
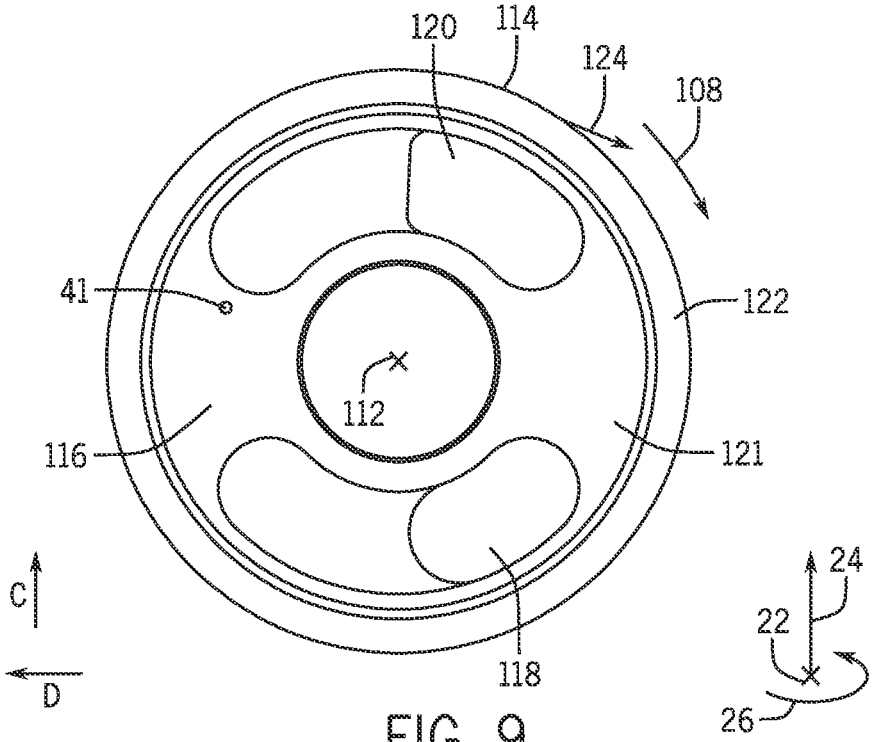
FIG. 9 is a radial view of an embodiment of an end cover of a rotary IPX (e.g., having a port or opening for improved duct pressure transfer during pressurization of a rotor duct volume)

FIG. 9 is a radial view of an embodiment of an end cover 114 of a rotary IPX 20 (e.g., having a duct or opening 41 for improved duct pressure transfer during pressurization of a duct volume). Specifically, as depicted in FIG. 9, the end cover 114 (e.g., high pressure inlet end cover) may include a port or opening 41 through a seal area 116 (e.g., low pressure seal area), or transition area (e.g., from low pressure outlet 118 to high pressure inlet 120 in the direction of rotation 108) of a surface 122 of the end cover 114 that interfaces with an end face of the rotor 38 adjacent to or just prior to the high pressure inlet 120. The surface 122 of the end cover 114 includes a transition area 121 disposed opposite the seal area 116 (e.g., from high pressure inlet 120 to the low pressure outlet 118 in the direction 108). The port or opening 41 is offset from a center point 112 of the end cover 114 and is aligned with a circumferential path of one or more rotor ducts 68 or passages. In embodiments, with more than one port or opening 41, each port or opening 41 may be aligned with a respective circumferential path of one or more respective rotor ducts 68 or passages. A high pressure fluid may enter into end cover 114 (and subsequently into the rotor duct 68 having a low pressure fluid) via the high pressure inlet 120. As the rotor duct 68 rotates in the circumferential direction 26 from the low pressure outlet 118 towards the high pressure inlet 120, the fluid interfaces with the seal area 116 (e.g., low pressure seal area) of the end cover 114 prior to reaching the high pressure inlet 120. Prior to reaching the high pressure inlet 120, a portion of fluid (high pressure fluid) may enter the rotor duct 68 via the port or opening 41 in the end cover 114 disposed adjacent to or just prior to the high pressure inlet 120 to enable pressurization of the fluid within the rotor duct 68. The remaining high pressure fluid may enter the rotor duct 68 via the high pressure inlet 120 of the end cover 114. An axis of injection of the opening or port 41 located adjacent to or just prior to the high pressure inlet 120 may be partly directed tangential to the rotor rotation and in the direction of rotation 108 to generate a velocity vector (as indicated by arrow 124) tangential to the direction of rotation 108. In certain embodiments, the port or opening 41 may be angled. In certain embodiments, the port or opening 41 may include a compound angle. For example, the port or opening 41 may be angled relative to an axis of rotation of the rotor 38. The angle of the port or opening 41 may range from approximately 0 to 90 degrees relative to the rotational axis of the rotor 38 in direction C from the low pressure outlet 118 towards the high pressure inlet 120. The angle in direction C may be between approximately 0 to 45 degrees, 45 to 90 degrees, 15 to 30 degrees, 60 to 75 degrees, and all subranges therein. For example, the angle in direction C may be approximately 0, 10, 20, 30, 40, 50, 60, 70, 80, or 90, or any other angle therebetween. Also, the port or opening 41 may be angled so that the port or opening 41 is tangential to the rotor duct 68. The angle of the port or opening 41 may range from approximately 0 to 90 degrees relative to the rotational axis of the rotor 38 in direction D (e.g., towards low pressure seal area 116 from opposite seal area 122) towards the radial wall of the rotor 38 or rotor duct 68. The angle in direction D may be between approximately 0 to 45 degrees, 45 to 90 degrees, 15 to 30 degrees, 60 to 75 degrees, and all subranges therein. For example, the angle in direction D may be approximately 0, 10, 20, 30, 40, 50, 60, 70, 80, or 90, or any other angle therebetween. In certain embodiments, the seal area 116 (e.g., low pressure seal area) may include more than one hole 41 adjacent to or just prior to the high pressure inlet 120. In certain embodiments, a cross-sectional area of the port or opening 41 may include an elliptical shape (e.g., oval or circle). In other embodiments, the cross-sectional area of the port or opening 41 may be another shape (e.g., triangular, rectilinear, star-shaped, and so forth). Location of port 41, shape of port 41, angle of port 41, and/or number of ports 41 is based the pressure, duct geometry, compressibility of fluid being utilized, and/or rotary speed of the rotor 38.

In some embodiments, the end cover 100 may include one or more ports 41 (in addition to or alternative to the ports 41 described in FIG. 8) disposed in the end cover 100 in the transition area 110 adjacent to the high pressure outlet 104 to help with pressurization of a duct volume as described in FIG. 9. In some embodiments, the end cover 114 may include one or more ports 41 (in addition to or alternative to the ports 41 described in FIG. 9) disposed in the end cover 114 in the transition area 121 adjacent to the low pressure outlet 118 to help with depressurization of a duct volume as described in FIG. 8.

Figure 10:
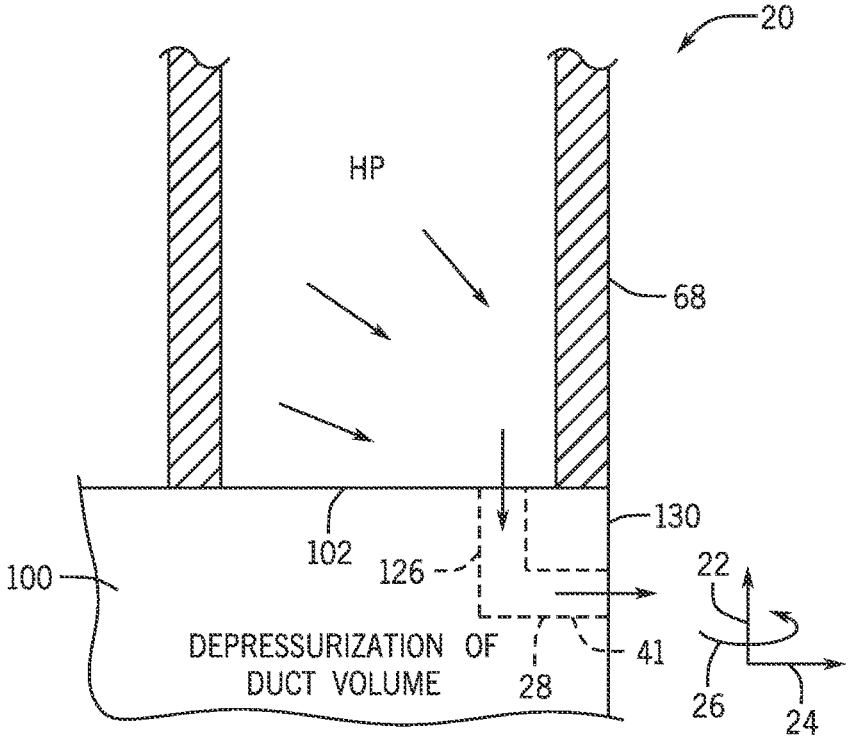
FIG. 10 is a partial cross-sectional view of an embodiment of a rotary IPX having an end cover having a port or opening to improve duct pressure transfer (e.g., during depressurization of a rotor duct volume)

FIG. 10 is a partial cross-sectional top view of an embodiment of a rotary IPX 20 having the end cover 100 (e.g., described in FIG. 8) having the port or opening 41 to improve duct pressure transfer (e.g., during depressurization of a duct volume). Specifically, as depicted in FIG. 10, the end cover 100 (e.g., low pressure inlet end cover) may include a port or opening 41 through a seal area 102 (e.g., high pressure seal area) or transition area (from high pressure outlet 104 to low pressure inlet 106) adjacent to or just prior to the low pressure inlet 106. As the rotor duct 68 rotates in the circumferential direction 26 from the high pressure outlet 104 towards the low pressure inlet 106, the fluid interfaces with the seal area 102 (e.g., high pressure seal area) of the end cover 100 prior to reaching the low pressure outlet 106. A portion of fluid (high pressure (HP) fluid) may exit the end cover via a first portion 126 of the port or opening 41 disposed adjacent to or just prior to the low pressure outlet 106 and subsequently exits the end cover 100 via a second portion 128 of the port or opening 41. The exit of the portion of the high pressure fluid through the port or opening 41 may enable a depressurization of the duct volume prior to interfacing with the low pressure fluid entering the rotor duct 68 via the low pressure inlet 106. Fluid may exit via the second portion 128 of the port or opening 41 at a radial side 130 of the end cover 100. In other embodiments, the second portion 128 of the port or opening 41 may enable the fluid to exit via a rear portion of the end cover 100. As discussed above, an axis of the first portion 126 of the opening or port 41 located adjacent to or just prior to the low pressure inlet 106 may be directed tangential to the rotor rotation and in the opposite direction of rotation to generate a reaction force and momentum in the direction of rotor rotation. In certain embodiments, the first portion 126 of the port or opening 41 may be angled. In certain embodiments, the port or opening may include a compound angle. For example, the port or opening 41 may be angled relative to an axis of rotation of the rotor 38. The angle of the port or opening 41 may range from approximately 0 to 90 degrees relative to the rotational axis of the rotor in direction A (see FIG. 8) from the high pressure outlet 104 towards the low pressure inlet 106. The angle in direction A may be between approximately 0 to 45 degrees, 45 to 90 degrees, 15 to 30 degrees, 60 to 75 degrees, and all subranges therein. For example, the angle in direction A may be approximately 0, 10, 20, 30, 40, 50, 60, 70, 80, or 90, or any other angle therebetween. Also, the port or opening 41 may be angled so that the port or opening 41 is tangential to the rotor duct 68. The angle of the port or opening 41 may range from approximately 0 to 90 degrees relative to the rotational axis of the rotor 38 in direction B (see FIG. 8) towards the radial wall of the rotor 38 or rotor duct 68. The angle in direction B may be between approximately 0 to 45 degrees, 45 to 90 degrees, 15 to 30 degrees, 60 to 75 degrees, and all subranges therein. For example, the angle in direction B may be approximately 0, 10, 20, 30, 40, 50, 60, 70, 80, or 90, or any other angle therebetween.

Figure 11:
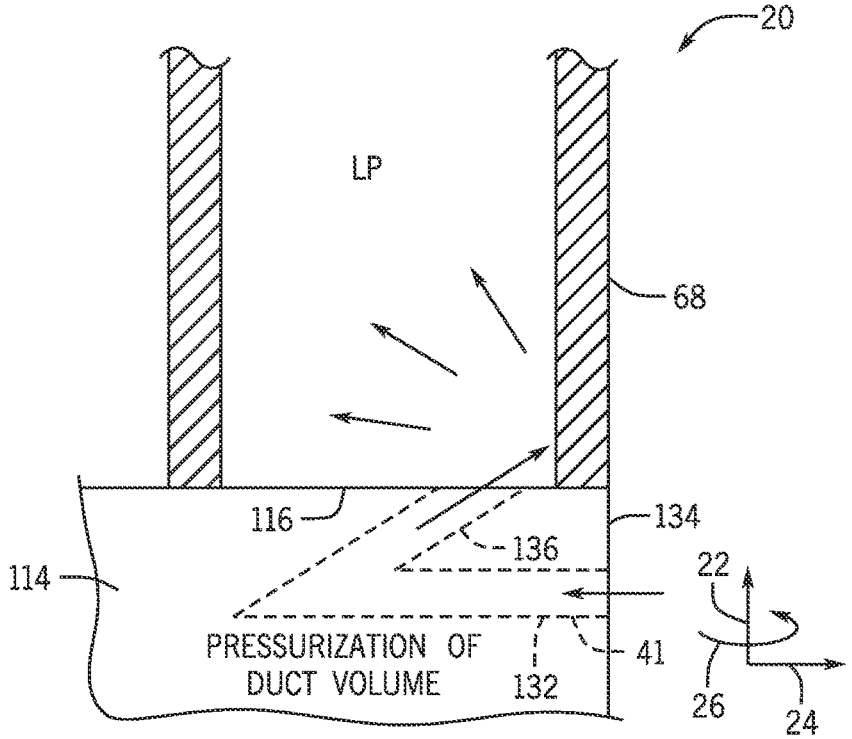
FIG. 11 is a partial cross-sectional view of an embodiment of a rotary IPX having an end cover having a port or opening to improve duct pressure transfer (e.g., during pressurization of a rotor duct volume)

FIG. 11 is a partial cross-sectional top view of an embodiment of a rotary IPX 20 having the end cover 114 (as described in FIG. 9) having the port or opening 41 to improve duct pressure transfer (e.g., during pressurization of a duct volume). Specifically, as depicted in FIG. 11, the end cover 114 (e.g., high pressure inlet end cover) may include the port or opening 41 through the seal area 116 (e.g., low pressure seal area) or transition area (e.g., from low pressure outlet 118 to high pressure inlet 120) adjacent to or just prior to the high pressure inlet 120. As the rotor duct 68 rotates in the circumferential direction 26 from the low pressure outlet 118 towards the high pressure inlet 120, the fluid interfaces with the seal area 116 (e.g., low pressure seal area) of the end cover 114 prior to reaching the high pressure inlet 120. Prior to reaching the high pressure inlet 120, a portion of fluid (high pressure (HP) fluid) may enter the rotor 38 or rotor duct 68 via the port or opening 41 in the end cover 114 disposed adjacent to or just prior to the high pressure inlet 120 to enable pressurization of the fluid within the rotor duct 68. The fluid first enters a first portion 132 of the port or opening 41 from a radial side 134 of the end cover 114 and then subsequently passes through a second portion 136 of the port or opening 41 into the rotor duct 68. In certain embodiments, the first portion 132 of the port or opening 41 may enable entrance of the fluid from a rear portion of the end cover 114. An axis of injection of the second portion 136 of the opening or port 41 located adjacent to or just prior to the high pressure inlet 120 may be directed tangential to the rotor rotation and in the direction of rotation. In certain embodiments, the second portion 136 of port or opening may be angled. In certain embodiments, the second portion 136 of the port or opening 41 may include a compound angle. For example, the second portion of the port or opening 41 may be angled relative to an axis of rotation of the rotor 38 (and/or the first portion 132 of the port or opening 41). The angle of the second portion 136 of the port or opening 41 may range from approximately 0 to 90 degrees relative to the rotational axis of the rotor 38 in direction C (see FIG. 9) from the low pressure outlet 118 towards the high pressure inlet 120. The angle in direction C may be between approximately 0 to 45 degrees, 45 to 90 degrees, 15 to 30 degrees, 60 to 75 degrees, and all subranges therein. For example, the angle in direction C may be approximately 0, 10, 20, 30, 40, 50, 60, 70, 80, or 90, or any other angle therebetween. Also, the second portion 136 of the port or opening 41 may be angled so that the port or opening 41 is tangential to the rotor duct 68. The angle of the second portion 136 of the port or opening 41 may range from approximately 0 to 90 degrees relative to the rotational axis of the rotor 38 in direction D (see FIG. 9) towards the radial wall of the rotor 38 or rotor duct 68. The angle in direction D may be between approximately 0 to 45 degrees, 45 to 90 degrees, 15 to 30 degrees, 60 to 75 degrees, and all subranges therein. For example, the angle in direction D may be approximately 0, 10, 20, 30, 40, 50, 60, 70, 80, or 90, or any other angle therebetween.

Figure 12:
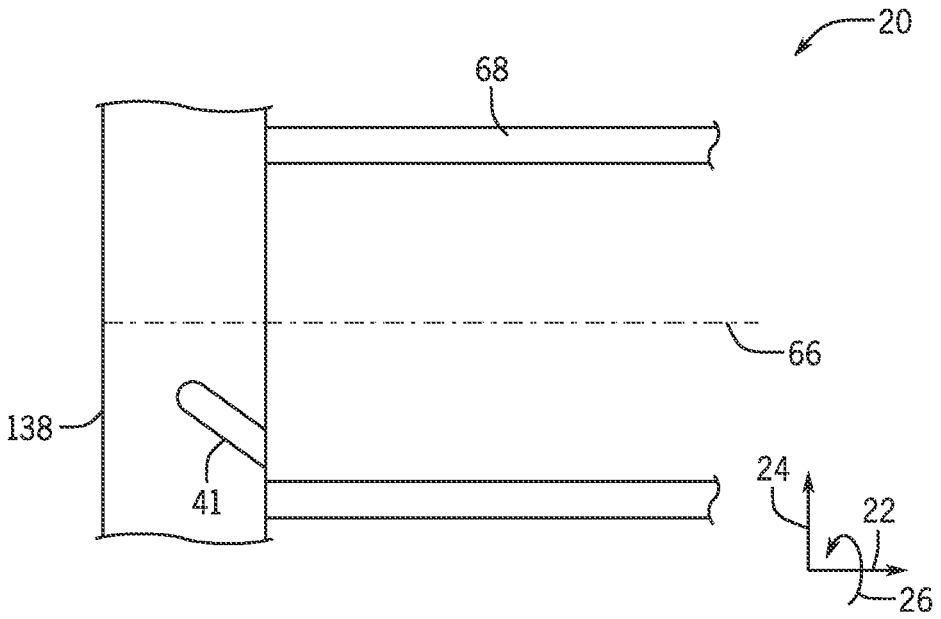
FIG. 12 is a partial cross-sectional side axial view of an embodiment of a rotary IPX having an end cover having a port or opening to improve duct pressure transfer (e.g., during depressurization of a rotor duct volume)

FIG. 12 is a partial cross-sectional side axial view of an embodiment of a rotary IPX 20 having an end cover 138 having a port or opening 41 to improve duct pressure transfer (e.g., during depressurization of a rotor duct volume). It should be noted only a portion of the port or opening 41 is depicted in FIG. 12. As depicted, a portion of the port or opening 41 may be angled. In certain embodiments, the port or opening 41 may include a compound angle. For example, the port or opening 41 may be angled relative to the axis of rotation 66 of the rotor 38. The angle of the port or opening 41 may range from approximately 0 to 90 degrees relative to the rotational axis 66 of the rotor 38 in direction A (see FIG. 8) from the high pressure outlet 104 towards the low pressure inlet 106. The angle in direction A may be between approximately 0 to 45 degrees, 45 to 90 degrees, 15 to 30 degrees, 60 to 75 degrees, and all subranges therein. For example, the angle in direction A may be approximately 0, 10, 20, 30, 40, 50, 60, 70, 80, or 90, or any other angle therebetween.

Figure 13:
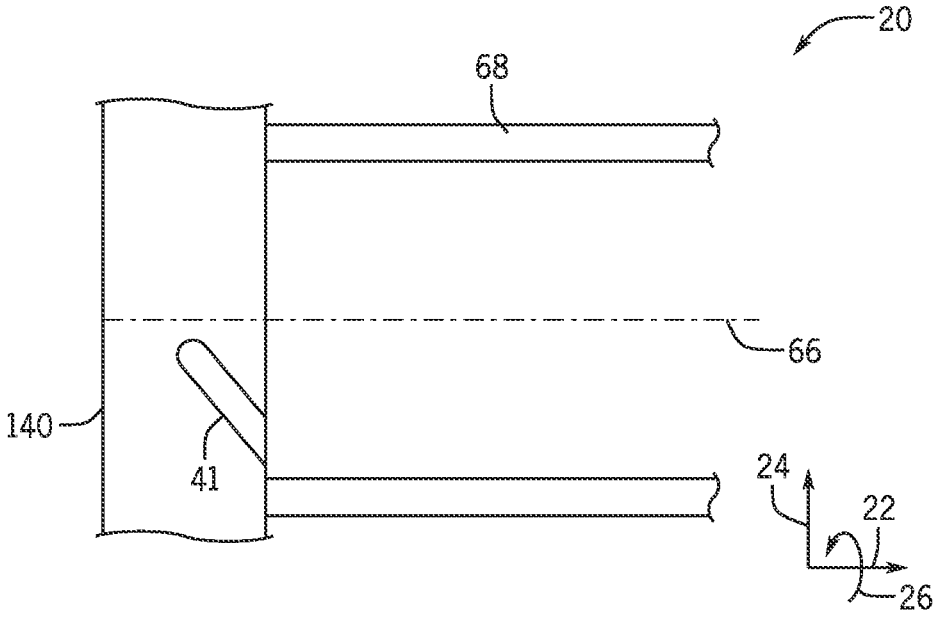
FIG. 13 is a partial cross-sectional top axial view of an embodiment of a rotary IPX having an end cover having a port or opening to improve duct pressure transfer (e.g., during depressurization of a rotor duct volume)

FIG. 13 is a partial cross-sectional top axial view of an embodiment of a rotary IPX 20 having an end cover 140 having a port or opening 41 to improve duct pressure transfer (e.g., during depressurization of a rotor duct volume). It should be noted only a portion of the port or opening 41 is depicted in FIG. 13. Also, a portion of the port or opening 41 may be angled so that the port or opening 41 is tangential to the rotor duct 68. The angle of the port or opening 41 may range from approximately 0 to 90 degrees relative to the rotational axis 66 of the rotor 38 in direction B (see FIG. 8) towards the radial wall of the rotor 38 or rotor duct 68. The angle in direction B may be between approximately 0 to 45 degrees, 45 to 90 degrees, 15 to 30 degrees, 60 to 75 degrees, and all subranges therein. For example, the angle in direction B may be approximately 0, 10, 20, 30, 40, 50, 60, 70, 80, or 90, or any other angle therebetween.

Figure 14:
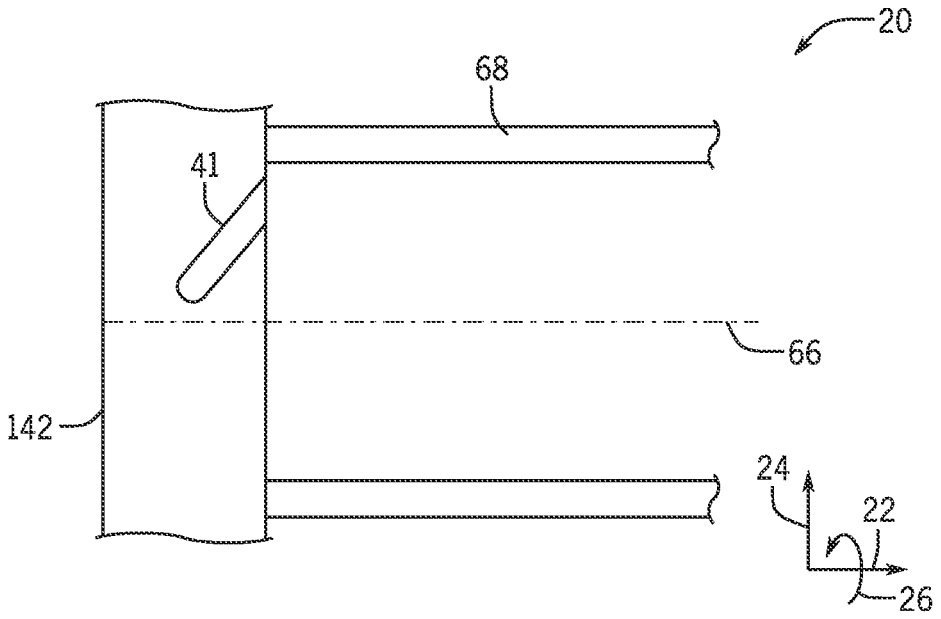
FIG. 14 is a partial cross-sectional side axial view of an embodiment of a rotary IPX having an end cover having a port or opening to improve duct pressure transfer (e.g., during pressurization of a rotor duct volume)

FIG. 14 is a partial cross-sectional side axial view of an embodiment of a rotary IPX 20 having an end cover 142 having a port or opening 41 to improve duct pressure transfer (e.g., during pressurization of a rotor duct volume). It should be noted only a portion of the port or opening 41 is depicted in FIG. 14. As depicted, a portion of the port or opening 41 may be angled. In certain embodiments, the port or opening 41 may include a compound angle. For example, the port or opening 41 may be angled relative to the axis of rotation 66 of the rotor 38. The angle of the port or opening 41 may range from approximately 0 to 90 degrees relative to the rotational axis 66 of the rotor 38 in direction C (see FIG. 9) from the low pressure outlet 118 towards the high pressure inlet 120. The angle in direction C may be between approximately 0 to 45 degrees, 45 to 90 degrees, 15 to 30 degrees, 60 to 75 degrees, and all subranges therein. For example, the angle in direction C may be approximately 0, 10, 20, 30, 40, 50, 60, 70, 80, or 90, or any other angle therebetween.

Figure 15:
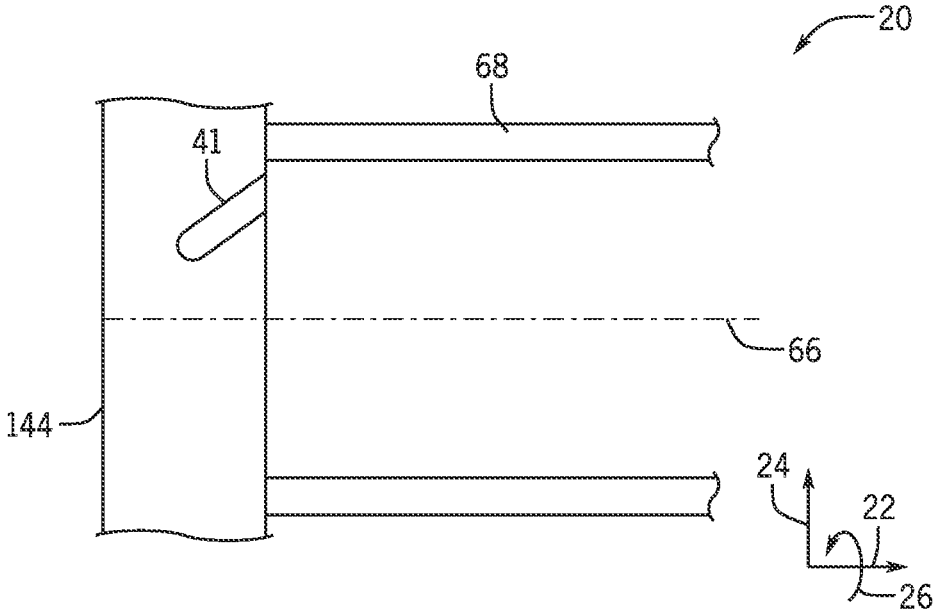
FIG. 15 is a partial cross-sectional top axial view of an embodiment of a rotary IPX having an end cover having a port or opening to improve duct pressure transfer (e.g., during pressurization of a rotor duct volume).

FIG. 15 is a partial cross-sectional top axial view of an embodiment of a rotary IPX 20 having an end cover 144 having a port or opening 41 to improve duct pressure transfer (e.g., during pressurization of a rotor duct volume). It should be noted only a portion of the port or opening 41 is depicted in FIG. 15. Also, a portion of the port or opening 41 may be angled so that the port or opening 41 is tangential to the rotor duct 68. The angle of the port or opening 41 may range from approximately 0 to 90 degrees relative to the rotational axis 66 of the rotor 38 in direction D (see FIG. 9) towards the radial wall of the rotor 38 or rotor duct 68. The angle in direction D may be between approximately 0 to 45 degrees, 45 to 90 degrees, 15 to 30 degrees, 60 to 75 degrees, and all subranges therein. For example, the angle in direction D may be approximately 0, 10, 20, 30, 40, 50, 60, 70, 80, or 90, or any other angle therebetween.

While the subject matter may be susceptible to various modifications and alternative forms, specific embodiments have been shown by way of example in the drawings and have been described in detail herein. However, it should be understood that the subject matter is not intended to be limited to the particular forms disclosed. Rather, the subject matter is to cover all modifications, equivalents, and alternatives falling within the spirit and scope of the subject matter as defined by the following appended claims.

What is claimed is:

1. A rotary isobaric pressure exchanger (IPX) for transferring pressure energy from a high pressure first fluid to a low pressure second fluid, comprising:

a cylindrical rotor configured to rotate circumferentially about a rotational axis and having a first end face and a second end face disposed opposite each other with a plurality of channels extending axially therethrough between respective apertures located in the first and second end faces;

a first end cover having a first surface that interfaces with and slidingly and sealingly engages the first end face, wherein the first end cover has at least one first fluid inlet and at least one first fluid outlet that during rotation of the cylindrical rotor about the rotational axis alternately fluidly communicate with at least one channel of the plurality of channels;

a second end cover having a second surface that interfaces with and slidingly and sealingly engages the second end face, wherein the second end cover has at least one second fluid inlet and at least one second fluid outlet that during rotation of the cylindrical rotor about the rotational axis alternately fluidly communicate with at least one channel of the plurality of channels; and a port disposed through the first surface of the first end cover or through the second surface of the second end cover and extending to an outermost radial side wall of the first end cover or the second end cover, wherein during rotation of the cylindrical rotor about the rotational axis the port is configured to fluidly communicate with at least one channel of the plurality of channels within the rotor, and wherein the port comprises a compound angle.

2. The rotary IPX of claim 1, wherein the second fluid inlet comprises a low pressure second fluid inlet, the second fluid outlet comprises a high pressure second fluid outlet, the second surface comprises a first transition area from the high pressure second fluid outlet to the low pressure second fluid inlet, and the port is disposed on the first transition area.

3. The rotary IPX of claim 2, wherein the port during rotation of the rotor between the high pressure second fluid outlet and the low pressure second fluid inlet is configured to fluidly communicate with the at least one channel of the plurality of channels to lower a pressure of the second fluid within the at least one channel prior to the low pressure second fluid inlet fluidly communicating with the at least one channel.

4. The rotary IPX of claim 3, wherein the port is disposed on the first transition area closer to the low pressure second fluid inlet than the high pressure second fluid outlet.

5. The rotary IPX of claim 3, wherein the port is oriented to generate a reaction force and momentum in a direction of rotation of the cylindrical rotor when the second fluid flows into the port.

6. The rotary IPX of claim 3, wherein the port is angled in a direction from the high pressure second fluid outlet towards the low pressure second fluid inlet between 0 and 90 degrees relative to the rotational axis of the cylindrical rotor.

7. The rotary IPX of claim 1, wherein the first fluid inlet comprises a high pressure first fluid inlet, the first fluid outlet comprises a low pressure first fluid outlet, the first surface comprises a first transition area from the high pressure first fluid inlet to the low pressure first fluid outlet, and the port is disposed on the first transition area.

8. The rotary IPX of claim 7, wherein the port during rotation of the rotor between the high pressure first fluid inlet and the low pressure first fluid outlet is configured to fluidly communicate with the at least one channel of the plurality of channels to lower a pressure of the first fluid within the at least one channel prior to the low pressure second fluid outlet fluidly communicating with the at least one channel.

9. The rotary IPX of claim 1, wherein the first fluid inlet comprises a high pressure first fluid inlet, the first fluid outlet comprises a low pressure first fluid outlet, the first surface comprises a first transition area from the low pressure first fluid outlet to the high pressure first fluid inlet, and the port is disposed on the first transition area.

10. The rotary IPX of claim 9, wherein the port during rotation of the rotor between the low pressure first fluid outlet and the high pressure first fluid inlet is configured to fluidly communicate with the at least one channel of the plurality of channels to increase a pressure of the first fluid within the at least one channel prior to the high pressure first fluid inlet fluidly communicating with the at least one channel.

11. The rotary IPX of claim 10, wherein the port is disposed on the first transition area closer to the high pressure first fluid inlet than the low pressure first fluid outlet.

12. The rotary IPX of claim 10, wherein the port is angled in a direction from the low pressure first fluid outlet towards the high pressure first fluid inlet between 0 and 90 degrees relative to the rotational axis of the cylindrical rotor.

13. The rotary IPX of claim 1, wherein the second fluid inlet comprises a low pressure second fluid inlet, the second fluid outlet comprises a high pressure second fluid outlet, the second surface comprises a first transition area from the low pressure second fluid inlet to the high pressure second fluid outlet, and the port is disposed on the first transition area.

14. The rotary IPX of claim 13, wherein the port during rotation of the rotor between the low pressure second fluid inlet and the high pressure second fluid outlet is configured to fluidly communicate with the at least one channel of the plurality of channels to increase a pressure of the second fluid within the at least one channel prior to the high pressure second fluid outlet fluidly communicating with the at least one channel.

15. A rotary isobaric pressure exchanger (IPX) for transferring pressure energy from a high pressure first fluid to a low pressure second fluid, comprising:

a cylindrical rotor configured to rotate circumferentially about a rotational axis and having a first end face and a second end face disposed opposite each other with a plurality of channels extending axially therethrough between respective apertures located in the first and second end faces; and a first end cover having a first surface that interfaces with and slidingly and sealingly engages the first end face, wherein the first end cover has a low pressure second fluid inlet, a high pressure second fluid outlet, and a first port disposed through the first surface of the first end cover between the low pressure second fluid inlet and the high pressure second fluid outlet, and the first port extends through the first end cover from the first surface to an outermost radial side wall of the first end cover, wherein the low pressure second fluid inlet, the high pressure second fluid outlet, and the first port are configured to fluidly communicate with at least one channel of the plurality of channels, and the first port during rotation of the rotor between the high pressure second fluid outlet and the low pressure second fluid inlet is configured to fluidly communicate with the at least one channel of the plurality of channels to lower a pressure of the second fluid within the at least one channel prior to the low pressure second fluid inlet fluidly communicating with the at least one channel, and wherein the first port comprises a compound angle.

16. The rotary IPX of claim 15, comprising a second end cover having a second surface that interfaces with and slidingly and sealingly engages the second end face, wherein the second end cover has a high pressure first fluid inlet, a low pressure first fluid outlet, and a second port disposed through the second surface of the second end cover between the high pressure first fluid inlet and the low pressure first fluid outlet, wherein the high pressure first fluid inlet, the low pressure first fluid outlet, and the second port are configured to fluidly communicate with at least one channel of the plurality of channels, and the second port during rotation of the rotor between the low pressure first fluid outlet and the high pressure first fluid inlet is configured to fluidly communicate with the at least one channel of the plurality of channels to increase a pressure of the first fluid within the at least one channel prior to the high pressure first fluid inlet fluidly communicating with the at least one channel.

17. The rotary IPX of claim 16, wherein the first port is disposed on the first surface closer to the low pressure second fluid inlet than the high pressure second fluid outlet, and the second port is disposed on the second surface closer to the high pressure first fluid inlet than the low pressure first fluid outlet.

18. The rotary IPX of claim 15, wherein the first port is oriented to generate a reaction force and momentum in a direction of rotation of the cylindrical rotor when the second fluid flows into the first port.

19. A rotary isobaric pressure exchanger (IPX) for transferring pressure energy from a high pressure first fluid to a low pressure second fluid, comprising:

a cylindrical rotor configured to rotate circumferentially about a rotational axis and having a first end face and a second end face disposed opposite each other with a plurality of channels extending axially therethrough between respective apertures located in the first and second end faces; and a first end cover having a surface that interfaces with and slidingly and sealingly engages the first end face, wherein the first end cover has a high pressure first fluid inlet, a low pressure first fluid outlet, and a port disposed through the surface of the first end cover between the high pressure first fluid inlet and the low pressure first fluid outlet, and the port extends through the first end cover from the surface to an outermost radial side wall of the first end cover, wherein the high pressure first fluid inlet, the low pressure first fluid outlet, and the port are configured to fluidly communicate with at least one channel of the plurality of channels, and the port during rotation of the rotor between the low pressure first fluid outlet and the high pressure first fluid inlet is configured to fluidly communicate with the at least one channel of the plurality of channels to lower a pressure of the first fluid within the at least one channel prior to the high pressure first fluid inlet fluidly communicating with the at least one channel, and wherein the port comprises a compound angle.

20. The rotary IPX of claim 19, wherein the port is disposed on the surface closer to the high pressure first fluid inlet than the low pressure first fluid outlet.

* * * * *